United States Patent [19]

Schiffers

[11] 4,406,139

[45] Sep. 27, 1983

[54] ROLLER ARRANGEMENT FOR DEWATERING FABRICS

[75] Inventor: Theo Schiffers, Aachen, Fed. Rep. of Germany

[73] Assignee: H. Krantz GmbH & Co., Aachen, Fed. Rep. of Germany

[21] Appl. No.: 378,066

[22] Filed: May 14, 1982

[30] Foreign Application Priority Data

Jun. 6, 1981 [DE] Fed. Rep. of Germany ..... 3122568
Jun. 6, 1981 [DE] Fed. Rep. of Germany ..... 3122569

[51] Int. Cl.[3] ..... D06B 15/02; B30B 3/04

[52] U.S. Cl. ..... 68/258; 100/162 B; 100/170

[58] Field of Search ..... 68/22 R, 22 A, 256, 68/258; 100/162 B, 168, 169, 170, 176; 72/243, 245; 29/116 R, 116 AD; 34/70

[56] References Cited

U.S. PATENT DOCUMENTS

| | | | |
|---|---|---|---|
| 2,138,397 | 11/1938 | Cannity | 100/170 X |
| 2,611,150 | 9/1952 | Goulding, Jr. | 72/245 X |
| 3,347,157 | 10/1967 | Kemp | 100/170 X |
| 3,416,341 | 12/1968 | Dey et al. | 72/245 X |
| 3,531,960 | 10/1970 | Stone | 100/162 B X |
| 4,154,160 | 5/1979 | Kosters | 100/170 X |

FOREIGN PATENT DOCUMENTS

| | | | |
|---|---|---|---|
| 2522965 | 12/1975 | Fed. Rep. of Germany | 100/170 |

*Primary Examiner*—Philip R. Coe
*Attorney, Agent, or Firm*—Arthur B. Colvin

[57] ABSTRACT

There is disclosed a dewatering roller assembly for Foulard fabrics or the like characterized in that the two rollers through which the fabric strip is passed are caused to bend or deform about mutually corresponding bending lines so that a uniform gap or a predictably variable gap between the rollers is achieved.

4 Claims, 2 Drawing Figures

ROLLER ARRANGEMENT FOR DEWATERING FABRICS

Figure 1:
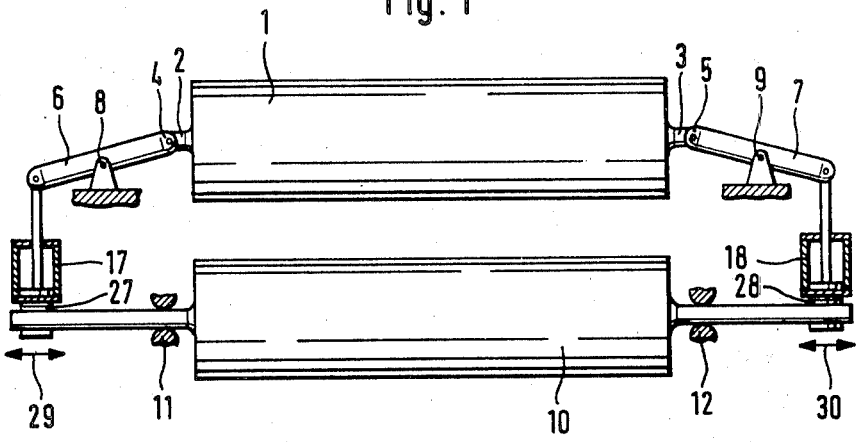

This invention relates to roller arrangements for dewatering Foulard and like fabrics and comprising a fixedly-mounted roller and a roller which is mounted so as to be variable in position for varying the gap between the two rollers.

For dewatering Foulard and like fabrics, in accordance with conventional practice, the fabric is moved through the nip between a pair of rollers pressed towards one another. It has, however, become apparent that rollers which are pressed onto one another with a fabric strip therebetween tend to bend or deflect in an uncontrolled manner, so that controlled dewatering of the fabric cannot be achieved.

The problem of the uncontrolled dewatering of such rollers is quite generally known in the art. Attempts have been made to obviate this bending or deflection, or to control it, as exemplified by German Offenlegungsschrift No. 2,222,256 and German Auslegeschrift No. 27,25,573. However, these proposals are bound up with undesirably large structural expenditure.

The problem underlying the invention is to provide a roller arrangement for fabric dewatering procedures, with which, despite bending or deflection of the individual rollers, controlled dewatering of Foulard and like fabrics can be achieved.

Pursuant hereto, the present invention provides a roller arrangement for dewatering Foulard or like fabrics and comprising a fixedly-mounted roller and a roller which is mounted so as to be variable in position for varying the gap between the two rollers, characterized in that the moveable roller is mounted with its axle ends each carried by a first arm of a respective two-armed lever having a fixed or fixable pivot or fulcrum and in that the rigidly-mounted roller has its axle ends projecting beyond respective mountings, and in that respective force-actuated expansion mechanisms are arranged between each said projecting axle end and the second arm of the corresponding two-armed lever. In accordance with a preferred embodiment each said force-actuated expansion mechanism is supported so as to be axially variable in position at least at the respective projecting axle end. Thus, in the arrangement of the invention, no attempt is made to prevent roller bending or deflection. On the contrary, the elastic behaviour of the rollers is utilized to induce bending of both rollers in a desired manner, whereby a roller gap of controlled size is achieved over the entire width of the rollers.

In accordance with a development of the invention it is proposed that the power-operated expansion mechanism should be in the form of a flow medium cylinder, i.e. a a hydraulic or air piston and cylinder arrangement. This provides a particularly simple means for loading the second arms of the two-armed levers and of the corresponding axle ends of the fixedly arranged roller and of thereby ensuring the desired loading of the rollers towards one another.

Figure 2:
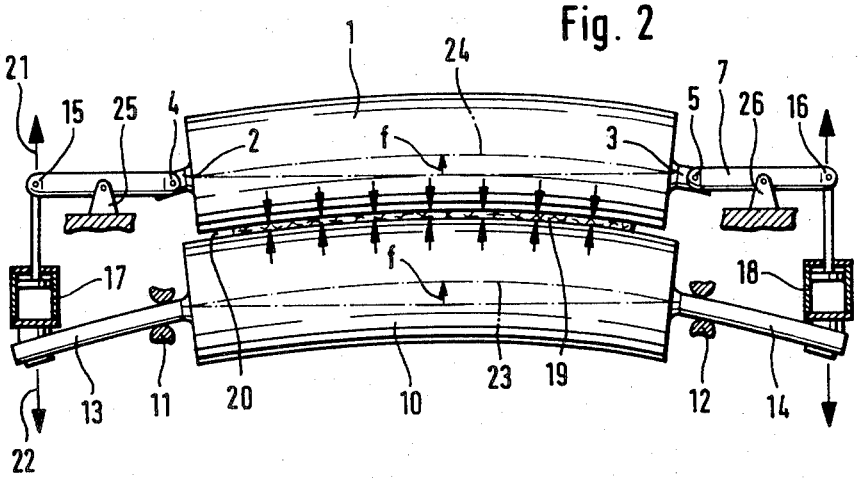

The invention will be described further, by way of example, with reference to the accompanying drawing, in which:

FIG. 1 is a diagrammatic view illustrating a preferred embodiment of the roller arrangement of the invention with its rollers separated; and FIG. 2 is a corresponding view of the arrangement of FIG. 1. but with the rollers closed up to their working positions.

The illustrated embodiment of the roller arrangement of the invention comprises a roller 10 mounted fixedly but rotatably by its axle ends 13 and 14 in mountings or bearings 11 and 12 in a roll stand which is not shown in detail. Arranged in the said roller stand are, furthermore, bearing blocks 25 and 26 in which two-armed levers 6 and 7 are mounted so as to be swingable about respective pivot points 8 and 9. The first or inner arms 4 and 5 respectively of these two-armed levers 6 and 7 each have a respective Cardan or universal joint mounting (not shown in detail) in which roller axle ends 2 and 3 respectively of moveable roller 1, are mounted.

The fixedly-mounted roller 10 has axle ends 13 and 14 projecting beyond the respective mountings 11 and 12. Arranged between these projecting axle ends 13 and 14 and the corresponding second or outer arms 15,16 of the two-armed levers 6,7 are respective expansion mechanisms 17 and 18. Each such expansion mechanism 17, 18 which preferably comprise a piston and cylinder arrangement, upon appropriate actuation forces apart the outer arms 15 or 16 of the two-armed levers 6,7 and the corresponding projecting axle ends 13 or 14 of the fixedly-mounted roller 10 in the directions indicated by the arrows 21 and 22. In the exemplified embodiment, each expansion mechanism 17, 18 is in the form of a flow medium cylinder or hydraulic ram.

When the expansion mechanisms 17 and 18 are actuated in the described manner, the roller 1, which is variable in position, is moved toward the fixedly mounted roller 10 and is finally pressed against the Foulard or like fabric 19 which is present between the two rollers 1 and 10, and thus against the fixedly-mounted roller 10. At the same time, because of the resulting reaction force occurring at the expansion mechanisms 17 and 18 by way of the projecting axle ends 13 and 14, a bending moment is introduced into the fixedly-mounted roller 10. This bending moment causes deformation or curving of the roller 10. Since the rollers 1 and 10 are coupled together forcewise, a corresponding deformation also occurs in the moveable roller 1. The introduced bending moments and the magnitude of the deformation of the rollers 1 and 10 can be calculated in accordance with customary and well established rules of statics, and by varying the ratio of the lever arms different effects can be attained. Both of the rollers 1 and 10 deform as a result of the force, introduced by way of the expansion mechanism 17 and 18, in the same magnitude and direction, so that they have mutually-corresponding bending lines 23 or 24 respectively. In this way the result is achieved that a uniform roller gap 20 occurs over the entire effective roller length, so that uniform dewatering of the Foulard fabric is achieved.

The expansion mechanisms 17 and 18 are, preferably supported so as to be axially variable in position with their cylinder fastening lugs or eyes 27 and 28 respectively on the projecting axle ends and can therefore be shifted in the direction of the arrow 29,30 respectively. In this way the bending behaviour of the rollers 1 and 10 can be influenced in a desired manner. For example, a variable roller gap having a desired rate of variation can be produced, whereby it is possible to keep the degrees of dewatering of the Foulard or like fabric different over its width in a desired manner.

Of course, the described change in position of the power-operated expansion mechanisms 17,18 along the axle ends can also be performed by motor (or in motorized manner) and during the squeezing and in accordance with a predetermined program. In this way it becomes possible to determine and also to pre-program the degree of dewatering arbitrarily in the transverse direction and in the longitudinal direction of the web.

Having thus described the invention and illustrated its use, what is claimed as new and is desired to be secured by Letters Patent is:

1. A roller arrangement for dewatering Foulard or like fabrics comprising a spaced pair of fixed bearings, a first roller having a shaft mounted in said bearings, the ends of said shaft projecting laterally beyond said bearings, a second roller movable toward and away from said first roller, said second roller including an axle, a fixed fulcrum member spaced from each end of said axle of said second roller, a lever pivotally mounted to each said fulcrum centrally of the ends of said lever to thus define inner and outer lever arms to opposite sides of said fulcrum, each of said outer lever arms overlying a respective projecting end portion of said shaft of said first roller, means connecting the ends of said axle to a respective inner lever arm and an expansion means at each side of said rollers interposed between and reacting against each said outer lever arm and a respective projecting portion of said shaft of said first roller, whereby extension of said expansion means shifts said second roller toward said first roller and causes said rollers to assume conforming curvatures.

2. Apparatus in accordance with claim 1 wherein said expansion means comprises a cylinder and piston assembly.

3. Apparatus in accordance with claim 1 wherein the length of the inner and outer arms of said levers is selected to effect substantially identical bending of said rollers.

4. Apparatus in accordance with claim 1, 2 or 3 including first and second connector means interposed between each said projecting portions of said shaft and said expansion means, said connector means being shiftable axially of said projecting portions to thereby vary the point of reaction of said expansion means against said shaft.

* * * * *